US010434676B2

(12) United States Patent
Kuendgen et al.

(10) Patent No.: US 10,434,676 B2
(45) Date of Patent: Oct. 8, 2019

(54) ROTARY DIE-CUTTER FOR CUTTING A PIECE OF MATERIAL OUT OF A PRINTING MATERIAL

(71) Applicant: HEIDELBERGER DRUCKMASCHINEN AG, Heidelberg (DE)

(72) Inventors: Rolf Kuendgen, Bad Schoenborn (DE); Rolf Grittmann, Schriesheim (DE); Philipp Doley, Heidelberg (DE); Benjamin Kreth, Waibstadt (DE); Reinhold Hiller, Pliezhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/044,808

(22) Filed: Jul. 25, 2018

(65) Prior Publication Data

US 2019/0039257 A1 Feb. 7, 2019

(30) Foreign Application Priority Data

Aug. 2, 2017 (DE) ..... 10 2017 213 389

(51) Int. Cl.
*B26F 1/44* (2006.01)
*B26D 7/01* (2006.01)
(Continued)

(52) U.S. Cl.
CPC ..... *B26F 1/44* (2013.01); *B26D 7/018* (2013.01); *B26D 7/1854* (2013.01);
(Continued)

(58) Field of Classification Search
CPC ..... B26F 1/44; B26F 1/46; B26F 2001/4409; B26F 2001/4418; B26F 2001/4427;
(Continued)

(56) References Cited

U.S. PATENT DOCUMENTS 3,172,321 A * 3/1965 Ernst Schrader ..... B31B 70/00 226/95
4,823,659 A * 4/1989 Falasconi ..... B26D 7/018 493/342
(Continued)

FOREIGN PATENT DOCUMENTS

DE 4000078 A1 7/1991
DE 29603669 U1 5/1996
(Continued)

*Primary Examiner* — Jason Daniel Prone
*Assistant Examiner* — Richard D Crosby, Jr.
(74) *Attorney, Agent, or Firm* — Laurence A. Greenberg; Werner H. Stemer; Ralph E. Locher

(57) ABSTRACT

A rotary die-cutter for cutting a piece of material or scrap out of a printing material such as paper, includes a die-cutting cylinder and an associated impression cylinder. The die-cutting cylinder is connected to a vacuum source. A die-cutting tool which is disposed on the die-cutting cylinder includes at least one die-cutting knife having a closed form and a suction opening within the closed form. A cylinder cover is disposed on the impression cylinder. At least one raised or recessed first guide element is disposed within the closed form for guiding suction air and/or at least one recessed or raised second guide element is disposed in the cylinder cover for guiding air. The scrap to be removed from the printing material can therefore be transported with the die-cutting cylinder and ejected from the die-cutting tool or knife in a trouble-free way.

6 Claims, 3 Drawing Sheets

(51) Int. Cl.
*B26D 7/18* (2006.01)
*B26F 1/38* (2006.01)

(52) U.S. Cl.
CPC ..... *B26D 7/1863* (2013.01); *B26F 1/384* (2013.01); *B26F 2001/4445* (2013.01); *B26F 2001/4472* (2013.01); *B26F 2001/4481* (2013.01)

(58) Field of Classification Search
CPC ..... B26F 2001/4436; B26F 2001/4445; B26F 2001/4454; B26F 2001/4463; B26F 2001/4472; B26F 2001/4481; B26F 2001/449
See application file for complete search history.

(56) References Cited

U.S. PATENT DOCUMENTS 4,878,407 A * 11/1989 Harrison ..... B26D 7/2614 83/13
5,109,741 A * 5/1992 Fuchs ..... B26D 7/1863 83/100
5,570,620 A * 11/1996 Okonski ..... B26D 1/0006 83/152
5,701,789 A * 12/1997 Okonski ..... B26D 7/1818 83/117
6,026,725 A * 2/2000 Okonski ..... B26D 7/1818 83/100
6,032,565 A * 3/2000 Okonski ..... B23Q 3/1556 492/31
6,371,902 B1 * 4/2002 Bluemle ..... B31B 50/00 493/370
6,494,123 B2 * 12/2002 Fuchs ..... B26D 7/2614 83/100
RE38,033 E * 3/2003 Okonski ..... B26D 7/018 83/152
6,532,854 B2 * 3/2003 Okonski ..... B26D 7/2628 83/698.31
6,915,829 B2 * 7/2005 Popp ..... A61F 13/15577 156/263
7,174,821 B2 * 2/2007 Geffros ..... B26D 7/18 76/107.8
7,752,947 B2 * 7/2010 Fiorani ..... B26D 3/16 425/527
9,327,417 B2 * 5/2016 Saga ..... B26D 1/405
9,636,839 B2 * 5/2017 Smithwick, Jr. ..... B26F 1/384
9,902,083 B2 * 2/2018 Long ..... A61F 13/15707
2003/0132549 A1 * 7/2003 Mlinar ..... B26F 3/002 264/293
2011/0036222 A1 * 2/2011 Raueiser ..... B26D 7/1863 83/100
2012/0111165 A1 * 5/2012 Closmann ..... B26D 7/1854 83/100

FOREIGN PATENT DOCUMENTS

DE 10147486 A1 6/2002
DE 102009033575 A1 1/2011
DE 102009033576 A1 1/2011
DE 102004058599 B4 9/2013
DE 102015223110 A1 5/2017
DE 102017208261 A1 12/2017
GB 2310628 A 9/1997

* cited by examiner

ROTARY DIE-CUTTER FOR CUTTING A PIECE OF MATERIAL OUT OF A PRINTING MATERIAL

CROSS-REFERENCE TO RELATED APPLICATION

This application claims the priority, under 35 U.S.C. § 119, of German Patent Application DE 10 2017 213 389.9, filed Aug. 2, 2017; the prior application is herewith incorporated by reference in its entirety.

BACKGROUND OF THE INVENTION

Field of the Invention

The present invention relates to a rotary die-cutter for cutting a piece of material out of a printing material.

The technical field of the invention is the graphic industry and in particular the field of die-cutting. In the further processing of printed products, die-cutting refers to separating materials such as paper, board, cardboard, or plastic foils in a separation line that is not a straight line. The material may be sheet-shaped or web-shaped. The die-cutting operation preferably is a knife-cutting operation, frequently using die-cutting knifes that have a closed form, for instance a circular or polygonal form.

Rotary die-cutting is done by a rotating die-cutting cylinder and an associated impression cylinder. Together, they form the die-cutting unit. The die-cutting cylinder carries the die-cutting tool with the die-cutting knifes that interact with the jacket surface or a cover of the impression cylinder. The cut-off waste (also referred to as scraps in the present application) may be removed in the die-cutting unit by suction. The blanks may be moved away for further processing such as stripping, dividing, separating or for being delivered.

Description of the Related Art

German Patent DE 10 2004 058 599 B4 discloses a device for an enhancing treatment of sheet-shaped substrates. The device includes two treatment tools, in particular rollers, that rotate and interact to cut the substrate. At least one of the rollers has passages that may be connected to a source of blown air and/or a vacuum source. In addition, a suction hood may be provided.

German Patent Application DE 101 47 486 A1 likewise discloses a die-cutting device including a magnet cylinder, an impression cylinder, and a suction device.

A problem that occurs in prior art equipment is that the (larger) scraps may cover the entire (smaller) suction opening of the processing tool. In such a case, the suction effect only acts on a small portion of the scrap, which may reduce the retaining force to a point where the scrap is no longer held securely. That means that the scraps may no longer be transported and removed in a reliable way.

SUMMARY OF THE INVENTION

It is accordingly an object of the invention to provide a rotary die-cutter for cutting a piece of material out of a printing material, which overcomes the hereinafore-mentioned disadvantages of the heretofore-known devices of this general type and which in particular allows scraps to be removed from the printing material in a trouble-free way and to be transported with the die-cutting cylinder and removed from the die-cutting tool or knife.

With the foregoing and other objects in view there is provided, in accordance with the invention, a rotary die-cutter for cutting a piece of material out of a printing material, which comprises a die-cutting cylinder and an associated impression cylinder guiding the printing material, the die-cutting cylinder being connected to a vacuum source and preferably alternately with a blown-air source, a die-cutting tool which is disposed on the die-cutting cylinder includes at least one die-cutting knife that has a closed form and a suction opening within the closed form, a cylinder cover is disposed on the impression cylinder, at least one raised or recessed first guide element guides suction air and preferably alternately blown air, the first guide element is disposed within the closed form and/or at least one recessed or raised second guide element guides air, preferably suction air and preferably alternately blown air and the second guide element is disposed in the cylinder cover.

The invention advantageously allows trouble-free rotary die-cutting, which means that scraps may be removed from the printing material, conveyed by the die-cutting cylinder or the die-cutting tool thereof, and removed from the die-cutting tool or the die-cutting knife thereof in a trouble-free way. For this purpose, in accordance with the invention, a first guide element is provided within the closed form and/or a second guide element is provided in the cylinder cover. In a preferred embodiment, both guide elements are provided. In a preferred embodiment, both guide elements interact.

The first guide element may guide the suction air to the piece of material or scrap, i.e. to its surface facing the die-cutting cylinder, in particular to its entire surface (reduced, of course, by the portion that is covered by the guide element or the support surface thereof). This may enhance the suction effect and the retaining force. If suction air is applied alternately instead of merely blown air, the separation of the scraps from the printing material may be improved.

The second guide element may guide air between the cylinder cover and the scrap as early as when the die-cutting knife disengages from the impression cylinder or the surface thereof. This improves the detachment of the scrap from the cylinder cover, in particular if the scrap adheres to the cylinder cover.

Another preferred development of the invention may be distinguished in that the first guide element is raised or recessed relative to the outer surface of the die-cutting tool and/or that the second guide element is recessed or raised relative to the outer surface of the cylinder cover. The die-cutting tool preferably has a thickness of between 0.1 mm and 0.2 mm (measured exclusive of the height of the die-cutting knives). The material of the die-cutting tool is preferably a metal, e.g. steel. The cylinder cover preferably has a thickness of between 0.05 mm and 0.2 mm. The material of the cylinder cover is preferably a plastic. The cylinder cover is preferably glued on, in particular in a removable way.

A further preferred development of the invention may be distinguished in that the raised first guide element and/or the second guide element is/are constructed as a rib. The rib may be straight or curved. The rib may extend to be radial or parallel to the axis of the impression cylinder. A single rib or multiple ribs may be provided. Multiple ribs are preferably of similar or identical construction. The rib height (measured relative to the outer surface of the die-cutting tool or cylinder cover) is preferably 0.05 to 0.2 millimeters.

An added preferred development of the invention may be distinguished in that the first guide element embodied as a rib is spaced apart from the die-cutting knife. The distance between the first guide element and the die-cutting knife is preferably between 0.2 and 1.0 millimeters.

An additional preferred development of the invention may be distinguished in that a support surface of the first guide element embodied as a rib is recessed relative to the die-cutting knife or the cutting edge thereof. The height difference is preferably between 0.1 and 0.5 millimeters.

Another preferred development of the invention may be distinguished in that the recessed first guide element and/or the second guide element is/are embodied as a groove. The groove may be straight or curved. The groove may extend to be radial or parallel to the axis of the impression cylinder. A single groove or multiple grooves may be provided. Multiple grooves are preferably of similar or identical construction. The groove depth (measured relative to the outer surface of the die-cutting tool or cylinder cover) is preferably 0.01 to 0.2 millimeters.

A further preferred development of the invention may be distinguished in that the second guide element embodied as a groove is disposed in the circumferential direction of the impression cylinder.

An added preferred development of the invention may be distinguished in that the second guide element embodied as a groove is disposed to be transverse to the circumferential direction of the impression cylinder.

An additional preferred development of the invention may be distinguished in that the cylinder cover is a foil or strip of foil and is glued to the surface of the impression cylinder. Preferably a strip of foil is used. The area of the foil preferably corresponds to the area of the printing material, in particular if the printing material is a sheet, or is greater than the area thereof. The longitudinal direction of the strip of foil is preferably disposed to be parallel to the axis of the impression cylinder and the width of the strip of foil in the transverse direction preferably corresponds at least to the extension of the die-cutting knife and ranges between 10 and 50 millimeters, for example.

A concomitant preferred development of the invention may be distinguished in that in the die-cutting process, the die-cutting knife penetrates into the cylinder cover and in particular passes through the cylinder cover. As a consequence, the piece of printing material is placed deeper in the die-cutting knife or the closed form thereof and may more easily be separated from the printing material.

Other features which are considered as characteristic for the invention are set forth in the appended claims. Any combinations of the features of the invention, of the features of further developments of the invention, and of the features of the exemplary embodiments of the invention also represent advantageous further developments of the invention. In addition, further developments of the invention may include the individual features or combinations of features disclosed in the above section titled "Field of the Invention."

Although the invention is illustrated and described herein as embodied in a rotary die-cutter for cutting a piece of material out of a printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
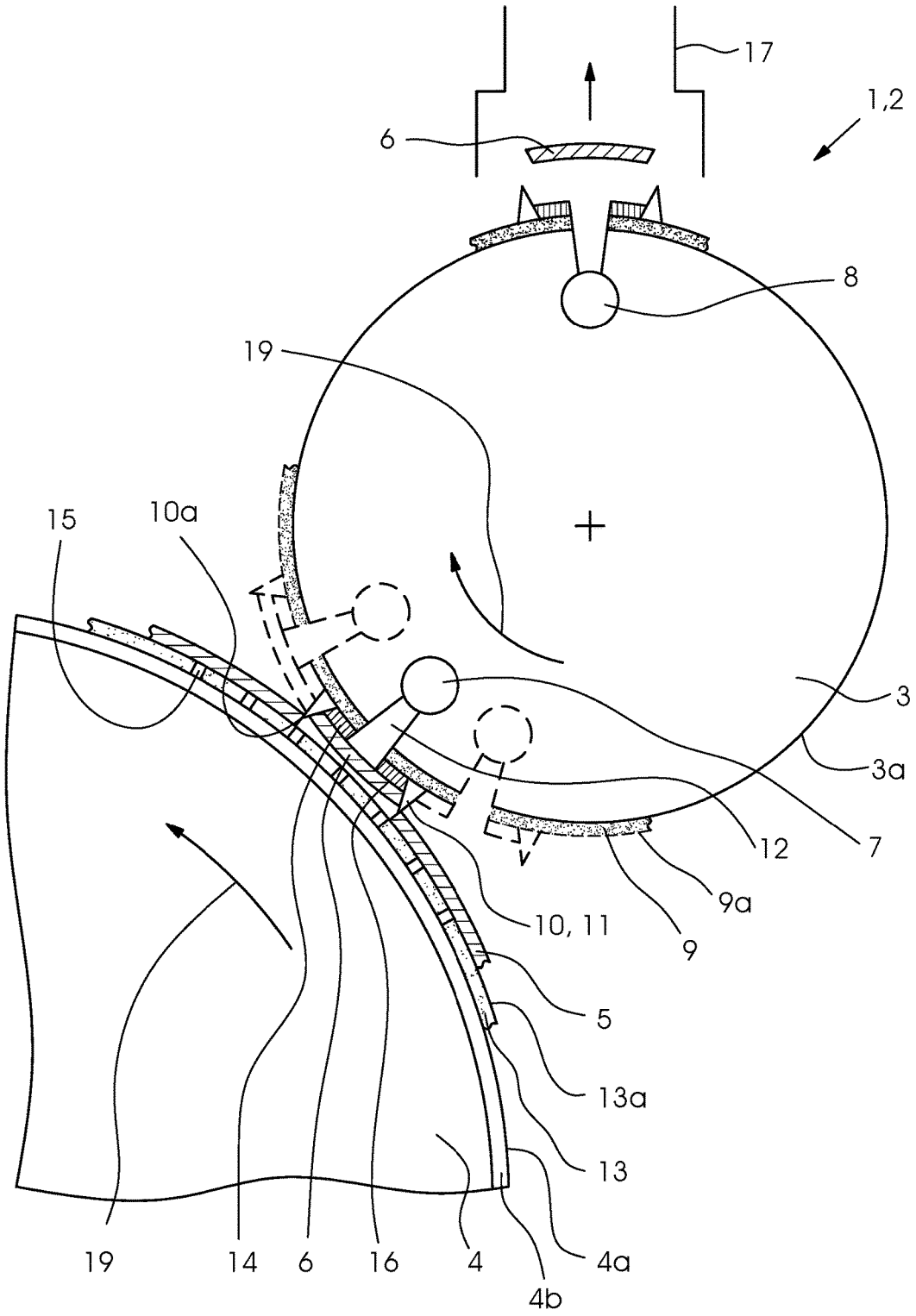
FIG. 1 is a fragmentary, diagrammatic, side-elevational view of a preferred exemplary embodiment of a rotary die-cutter of the invention.

Referring now to the figures of the drawings in detail and first, particularly, to FIG. 1 thereof, there is seen a side view of a machine, in particular a printing machine 1 or a rotary die-cutter 2 of such a machine. The rotary die-cutter may likewise form a die-cutting unit of the machine. The machine may, for instance, be a Speedmaster® 52 manufactured by Heidelberger Druckmaschinen AG.

The rotary die-cutter includes a die-cutting cylinder 3 and an impression cylinder 4 associated and interacting with the die-cutting cylinder 3. The impression cylinder transports a printing material 5, in particular a sheet made of paper, board, cardboard, or foil (plastic or metal/metalized). The rotary die-cutter is provided or constructed to cut a piece of material (or a so-called scrap) 6 out of the printing material.

The die-cutting cylinder 3 is connected to a vacuum source 7 and to a blown-air source 8. The suction air that is provided in this way is used to apply suction to the piece of material 6 during the die-cutting operation (at a first angular position) and the blown air that is provided acts to remove the piece of material/scrap after the die-cutting operation (at a second angular position).

A die-cutting tool 9 is received on the surface 3*a* of the die-cutting cylinder and is held, for instance, by magnetic force. The die-cutting tool includes at least one die-cutting knife 10, preferably a plurality of die-cutting knives. The die-cutting knife has a closed form, contour, outline, geometry or shape 11, in particular a so-called ring form. The ring form may be a circle, oval, square, or rectangle. Other forms or loops of any desired shape are likewise possible.

The die-cutting tool 9 has at least one suction opening 12 disposed within the closed form 11 of the die-cutting knife 10, for instance a central and/or circular suction opening. The suction opening 12 communicates with the vacuum source 7, for instance through a radial and/or axial bore of the die-cutting cylinder 3 and a rotary feedthrough of the die-cutting cylinder. The suction opening is small as compared to the area bordered by the closed form (knife contour), and preferably takes up less than 50% or less than 25% or less than 10% thereof.

A plate 4*b* is received on the surface 4*a* of the impression cylinder 4. The plate 4*b* carries a cylinder cover 13. The cylinder cover is preferably a foil or preferably a narrow strip of foil (parallel to the axial direction of the impression cylinder 4). The cylinder cover is preferably glued to the surface of the impression cylinder.

As it cuts the printing material 5, the die-cutting knife 10 and in particular a cutting edge 10*a* thereof, penetrates into the printing material 5 and passes through the latter. In addition, the die-cutting knife and the cutting edge thereof penetrates into the cylinder cover 13 and passes through the cylinder cover 13, so the cutting edge contacts the surface 4*a* of the impression cylinder 4. Since the cylinder sleeve 13 is glued to the surface of the impression cylinder, the cylinder cover piece located within the closed form 11 cannot be removed from the impression cylinder by the suction effect. In addition, it is covered by the piece of material 6.

The piece of material 6 that has likewise been cut out of the printing material 5 by the die-cutting knife 10 and the cutting edge 10*a* thereof is removed, however, from the cylinder cover 13 by the suction air of the suction opening 12 and the vacuum source 7 and moved to the die-cutting tool 9 in particular to an outer surface 9*a* thereof. The removal of the piece of material 6 is improved by at least one second guide element 15, in particular a groove, in the cylinder 13. Due to the rotary movements of the two cylinders 3 and 4, the die-cutting knife 10 and the cutting edge 10*a* thereof move away from the surface 4*a* of the impression cylinder 4, allowing air to pass through the second guide element and reach a space between the cylinder cover 13 and the piece of material 6.

The piece of material 6 comes to rest on at least one first guide element 14, preferably a rib, of the die-cutting tool 9. In accordance with the invention, the first guide element advantageously prevents the piece of material 6 from completely covering the suction opening 12 and thus causing the suction effect and retaining force to decrease. The first guide element or rib 14 preferably includes at least one support surface 16 for the piece of material 6 to rest on. The effective diameter of the suction opening is advantageously increased by the first guide element. In addition, the first guide element may advantageously reduce the amount of air that is undesirably sucked in.

Due to the rotation of the die-cutting cylinder 3, the piece of material 6 is moved out of the gap between the two cylinders 3 and 4 and into the effective range of a suction hood 17. At this location, the suction opening 12 is separated from the vacuum source 7 and connected to the blown-air source 8, transforming the suction opening into a blow opening and causing the piece of material 6 to be blown out of the closed form to be removed by the suction hood 17.

Figure 2:
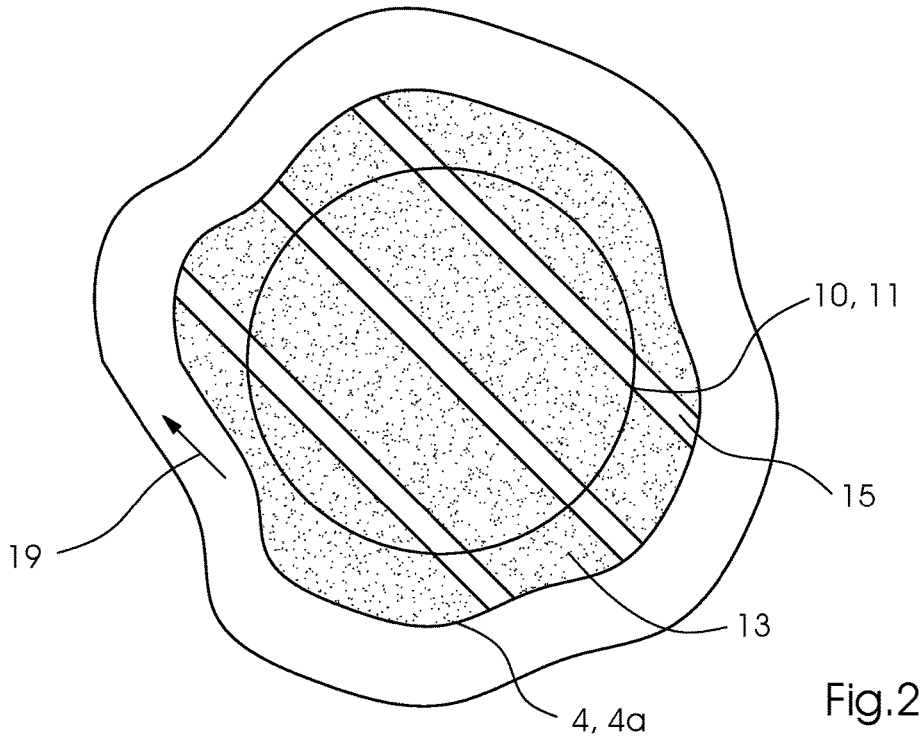
FIG. 2 is a fragmentary, top-plan view of the exemplary embodiment of FIG. 1.

FIG. 2 is a top view of a detail of the impression cylinder 4 with a cylinder cover 13 disposed on the surface 4*a* of the impression cylinder 4. The cylinder cover includes at least a second guide element 15, which is embodied as a groove in the illustrated example. As shown, the groove or plurality of grooves may be oriented to be substantially parallel to a circumferential direction 19 of the impression cylinder 4. A comparison between FIGS. 1 and 2 shows that in FIG. 1, the second guide element is not oriented to be parallel to the circumferential direction 19 but substantially transverse to the circumferential direction 19. Both orientations are possible.

In addition, FIG. 2 diagrammatically shows the die-cutting knife 10 and the closed form 11 thereof. It can be seen that the space bordered by the closed form is connected to the exterior space by using the at least one second guide element 15, allowing air to enter the interior of the closed form 11 as the die-cutting knife disengages from the impression cylinder 4.

Figure 3:
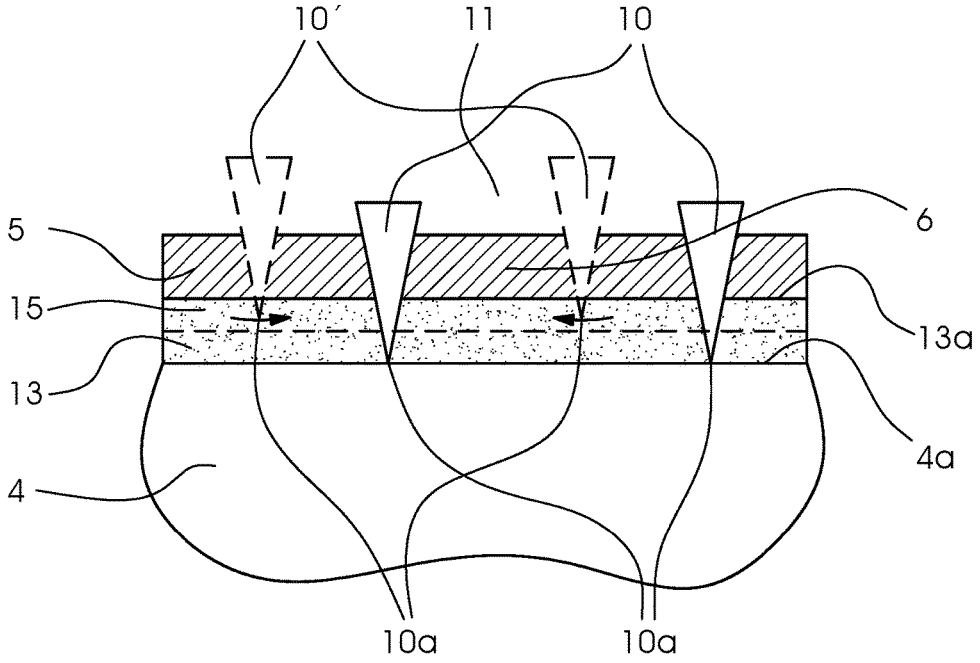
FIG. 3 is a fragmentary, cross-sectional view of the exemplary embodiment of FIG. 1.

FIG. 3 is a diagrammatic illustration of how air enters the closed form 11. The cylinder cover 13 with its outer surface 13*a* is received on the impression cylinder 4, in particular on the surface 4*a* thereof. A groove 15 is formed in the cylinder cover 13. A printing material 5 rests on the cylinder cover. The die-cutting knife 10 or the cutting edge 10*a* thereof, penetrates the printing material 5 and the cylinder cover 13 as far as the surface 4*a*.

FIG. 3 also illustrates the die-cutting knife 10' (which is horizontally offset for better visibility) in a further vertical position in which the die-cutting knife has moved away from the surface 4*a*. As soon as the cutting edge 10*a* at least partly releases the groove 15, air may pass underneath the cutting edge and into the interior of the closed form 11. This assists in the removal of the piece of material 6 from the cylinder cover 13. In particular when plastic foils, e.g. so-called in-mold foils, are being cut, the presence of air between the cylinder cover 13 and the scrap 6 is an advantage because such scraps tend to get stuck to the cylinder cover.

Figure 4A:
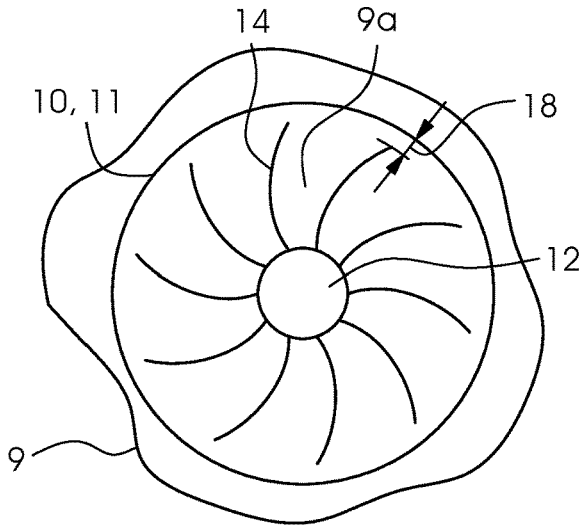
FIGS. 4A, 4B and 4C are fragmentary, top-plan views of embodiments of a first guide element.
Figure 4B:
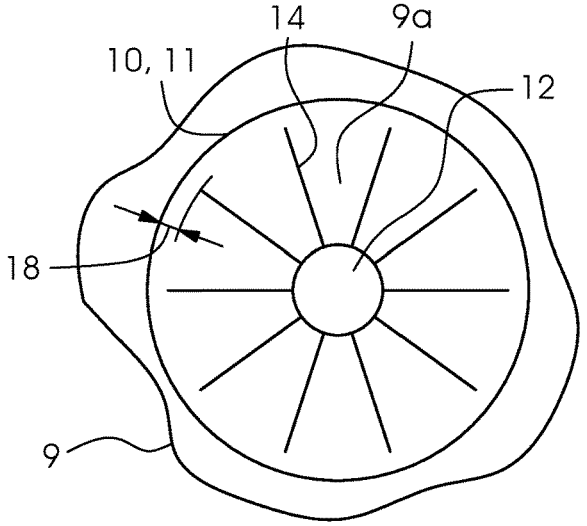
Figure 4C:
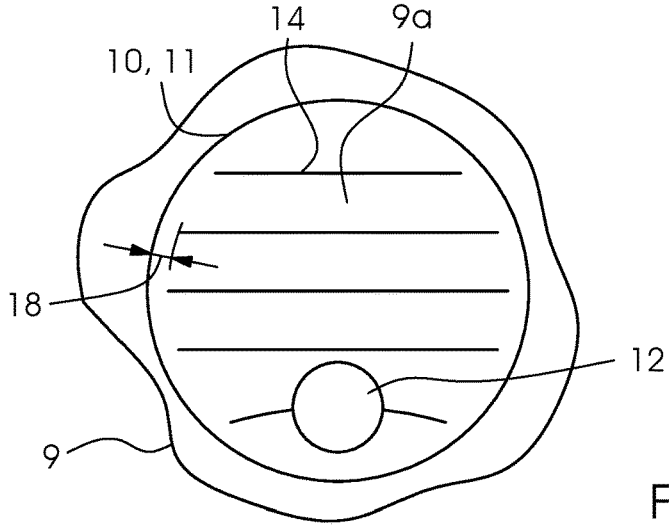

FIGS. 4A to 4C illustrate different embodiments of the first guide element 14 in the preferred form of ribs 14.

FIG. 4A illustrates a substantially circular die-cutting knife 10 and a suction opening 12 that is at the center of the circular knife. The ribs 14 extend from the suction opening 12 but are curved instead of radial. The ends of the ribs 14 do not touch the die-cutting knife 10 but are spaced-apart from the latter. The provision of such a spacing 18 between the ribs 14 and the die-cutting knife 10 simplifies the manufacturing of the die-cutting knife by etching and subsequent treatment with a milling head. Due to the spacing 18, a milling head may be guided accurately along the contour of the die-cutting knife 10 and the contour of the rib 14.

FIGS. 4B and 4C illustrate alternative embodiments. In accordance with the embodiment of FIG. 4B, the suction opening 12 is at the center and the ribs 14 are precisely radial while maintaining the spacing 18.

In accordance with the embodiment of FIG. 4C, the suction opening 12 is not at the center but closer to the die-cutting knife 10 in the printing material transport direction and the ribs 14 are substantially parallel to one another and transverse to the transport direction while keeping a distance from the die-cutting knife. The selection of such a suction opening position may advantageously improve the removal of the scrap.

The suction opening 12 may be an elongated hole or a hole of any desired contour, in particular in the embodiment of FIG. 4C.

The following is a summary list of reference numerals and the corresponding structure used in the above description of the invention:

1 machine/printing machine
2 rotary die-cutter/die-cutting unit
3 die-cutting cylinder
3*b* plate
4 impression cylinder
4*a* surface
4*b* plate
5 printing material
6 piece of material/scrap
7 vacuum source
8 blown-air source
9 die-cutting tool
9*a* outer surface
10 die-cutting knife
10*a* cutting edge
10' die-cutting knife
11 closed form
12 suction opening/blow opening
13 cylinder cover/foil/strip of foil
13*a* outer surface
14 first guide element/rib

15 second guide element/groove
16 support surface
17 suction hood
18 distance
19 circumferential direction

The invention claimed is:

1. A rotary die-cutter for cutting a piece of material out of a printing material, the rotary die-cutter comprising:

a die-cutting cylinder and an associated impression cylinder;

a vacuum source connected to said die-cutting cylinder;

a die-cutting tool disposed on said die-cutting cylinder and having an outer surface, said die-cutting tool including at least one die-cutting knife having a cutting edge, a closed form and a suction opening within said closed form;

a cylinder cover disposed on said impression cylinder and having an outer surface;

at least one raised first guide element being a rib raised relative to said outer surface of said die cutting tool, being disposed within said closed form and being spaced apart from said die cutting knife for guiding suction air towards said vacuum source, said rib having a support surface located on a radially lower level than said cutting edge; and at least one recessed second guide element being a groove recessed relative to said outer surface of said cylinder cover and being disposed in said cylinder cover for guiding air towards said vacuum source.

2. The rotary die-cutter according to claim 1, wherein said groove of said second guide element extends in a circumferential direction of said impression cylinder.

3. The rotary die-cutter according to claim 1, wherein said groove of said second guide element extends transverse to a circumferential direction of said impression cylinder.

4. The rotary die-cutter according to claim 1, wherein said impression cylinder has a surface, and said cylinder cover is a foil or a strip of foil being glued to said surface of said impression cylinder.

5. The rotary die-cutter according to claim 1, wherein said die-cutting knife is configured to penetrate said cylinder cover.

6. The rotary die-cutter according to claim 1, wherein said die-cutting knife is configured to penetrate and pass through said cylinder cover.

* * * * *